US010458688B2

(12) United States Patent
Trnka et al.

(10) Patent No.: US 10,458,688 B2
(45) Date of Patent: Oct. 29, 2019

(54) FROST MANAGEMENT OF AN EVAPORATOR

(71) Applicant: HONEYWELL INTERNATIONAL INC., Morris Plains, NJ (US)

(72) Inventors: Pavel Trnka, Prague (CZ); Paul McGahan, Prague (CZ)

(73) Assignee: Honeywell International Inc., Morris Plains, NJ (US)

( * ) Notice: Subject to any disclaimer, the term of this patent is extended or adjusted under 35 U.S.C. 154(b) by 280 days.

(21) Appl. No.: 15/466,516

(22) Filed: Mar. 22, 2017

(65) Prior Publication Data

US 2018/0274833 A1 Sep. 27, 2018

(51) Int. Cl.
*F25B 47/02* (2006.01)

(52) U.S. Cl.
CPC ..... *F25B 47/02* (2013.01); *F25B 2500/05* (2013.01); *F25B 2500/18* (2013.01); *F25B 2500/19* (2013.01); *F25B 2600/01* (2013.01); *F25B 2600/23* (2013.01)

(58) Field of Classification Search
CPC .. F25B 47/02; F25B 2500/05; F25B 2500/18; F25B 2500/19; F25B 2600/01; F25B 2600/23
See application file for complete search history.

(56) References Cited

U.S. PATENT DOCUMENTS

2005/0039473 A1* 2/2005 Pondicq-Cassou ..... F25B 9/008 62/196.4
2015/0285539 A1* 10/2015 Kopko ..... F25B 5/02 62/115

FOREIGN PATENT DOCUMENTS

| | | | | |
|---|---|---|---|---|
| CN | 105387665 A | | 3/2016 | |
| CN | 105387665 | * | 9/2016 | ..... F25B 47/02 |
| EP | 2320168 A1 | | 5/2011 | |
| GB | 2528213 A | | 1/2016 | |
| JP | 2007225158 A | | 9/2007 | |

OTHER PUBLICATIONS

Extended Search Report from related EP Application No. 16162107.3 dated Sep. 6, 2016, 8 pages.

(Continued)

*Primary Examiner* — Edward F Landrum
*Assistant Examiner* — Daniel C Comings
(74) *Attorney, Agent, or Firm* — Shumaker & Sieffert, P.A.

(57) ABSTRACT

Methods, devices, and systems for frost management of an evaporator are described herein. One device includes a memory, and a processor configured to execute executable instructions stored in the memory to receive operating information of a heat pump, determine a first set point of at least one of a number of components of the heat pump and a first operating temperature, receive a second operating temperature of the evaporator that is positively offset from the first operating temperature of the evaporator, determine a second set point of at least one of the number of components of the heat pump based on the second operating temperature, and modify a set point of at least one of the number of components of the heat pump to the second set point such that a heating mode of the heat pump is enabled for a heating interval length of the heat pump.

20 Claims, 3 Drawing Sheets

(56) References Cited

OTHER PUBLICATIONS

Communication pursuant to Article 94(3) EPC from related European Patent Application No. 16162107.3, dated Aug. 22, 2018 4 pages.
Response to Extended Search Report dated Sep. 5, 2016, from counterpart European Application No. 16162107.3, filed Dec. 22, 2016, 17 pp.
Response to Examination Report dated Aug. 22, 2018, from counterpart European Application No. 16162107.3, filed Jan. 30, 2018, 12 pp.

* cited by examiner

FROST MANAGEMENT OF AN EVAPORATOR

CROSS REFERENCE TO RELATED APPLICATION

This application claims priority to EP Application No. 16162107.3, filed Mar. 23, 2016, which is incorporated herein by reference in its entirety.

TECHNICAL FIELD

The present disclosure relates to methods, devices, and systems for frost management of an evaporator.

BACKGROUND

Heat can be transported from low temperature reservoirs, such as from ambient outdoor air, to high temperature reservoirs, such as to an indoor building space, by using mechanical and/or electrical energy input to a device such as a heat pump. Heat pumps can use an evaporator to remove heat from air. Operating temperatures of an evaporator of a heat pump evaporator are typically lower than the temperature of the air. If the temperature of the evaporator is below the dew point of the air, moisture in the air can condense on the evaporator surface. Moreover, if the air temperature is below the freezing point, the condensed moisture on the evaporator surface can turn to ice.

The efficiency of the heat pump can suffer if ice formation on the evaporator surface occurs. That is, as ice forms on the surface of the evaporator of the heat pump, the efficiency of the heat pump can be reduced. When ice formation occurs, it can be necessary to perform defrosting of the evaporator surface to melt the ice that has formed.

DETAILED DESCRIPTION

Figure 1:
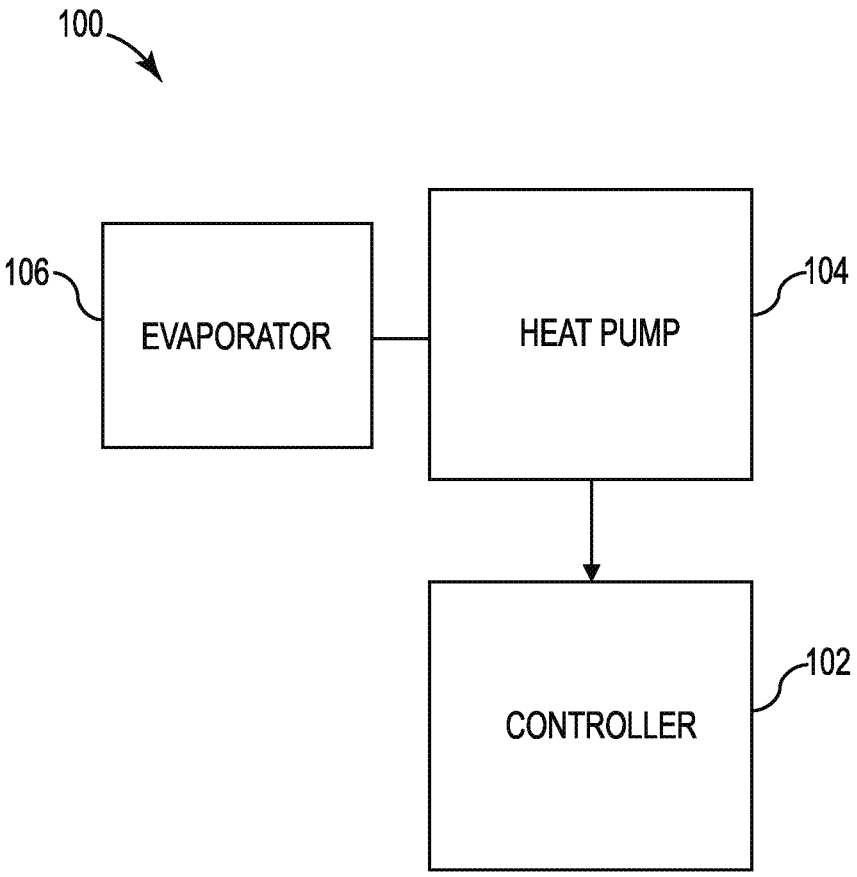
FIG. 1 illustrates a system for frost management of an evaporator, in accordance with one or more embodiments of the present disclosure.

Methods, devices, and systems for frost management of an evaporator are described herein. For example, one or more embodiments include a memory, and a processor configured to execute executable instructions stored in the memory to receive operating information of a heat pump, determine a first set point of at least one of a number of components of the heat pump and a first operating temperature of an evaporator that correspond to operation of the heat pump at a first operating energy efficiency based on the operating information of the heat pump, receive a second operating temperature of the evaporator that is positively offset from the first operating temperature of the evaporator associated with the operating information of the heat pump, determine a second set point of at least one of the number of components of the heat pump that correspond to an operation of the heat pump at a second operating energy efficiency corresponding to the second operating temperature of the evaporator of the heat pump based on the operating information of the heat pump based on the operating information of the heat pump, and modify a set point of at least one of the number of components of the heat pump to the second set point such that a heating mode of the heat pump is enabled for a heating interval length of the heat pump.

Performing a defrost interval can remove ice from a surface of an evaporator of a heat pump and restore an efficiency of the heat pump to a level of that prior to ice formation. While a defrost interval may increase the efficiency of the heat pump by removing the ice from the evaporator, the heat pump can consume additional energy to perform the defrost interval, increasing a cost of operation of the heat pump.

Overall cost of operation of a heat pump can be characterized by the heating costs and the defrosting costs of the heat pump, as well as the duration of a complete heating interval length and defrost interval length. Frost management of an evaporator, in accordance with the present disclosure, can extend a heating interval length of the heat pump to decrease the length of a defrost interval of the heat pump and/or the number of defrost intervals, thereby decreasing the overall cost of operation of the heat pump.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process, electrical, and/or structural changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

Figure 3:
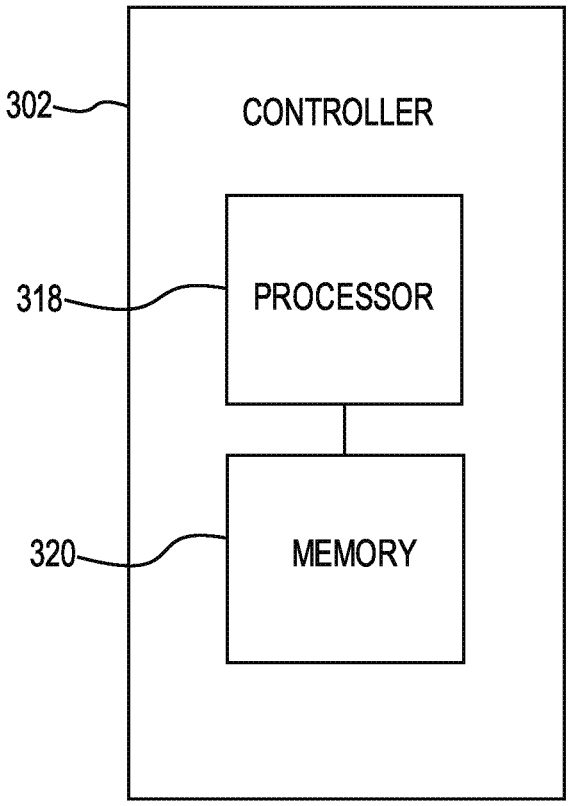
FIG. 3 is a schematic block diagram of a controller for frost management of an evaporator, in accordance with one or more embodiments of the present disclosure.

The figures herein follow a numbering convention in which the first digit or digits correspond to the drawing figure number and the remaining digits identify an element or component in the drawing. Similar elements or components between different figures may be identified by the use of similar digits. For example, controller 102 as shown in FIG. 1 can be controller 302, as shown in FIG. 3.

As used herein, "a" or "a number of" something can refer to one or more such things. For example, "a number of components" can refer to one or more components.

FIG. 1 illustrates a system for frost management of an evaporator, in accordance with one or more embodiments of the present disclosure. As shown in FIG. 1, system 100 can include a controller 102, a heat pump 104, and an evaporator 106.

Controller 102 can receive operating information of heat pump 104. Operating information of heat pump 104 can include a heat demand of heat pump 104. For example, a heat demand can refer to a request for a change in temperature of a building space (e.g., to be heated) by heat pump 104. That is, an occupant of the building space may set (e.g., via a thermostat) the building space to a desired temperature (e.g., set point), and heat pump 104 can supply the building space with heat based on the heat demand to the set point temperature.

Operating information of heat pump 104 can include instantaneous operating conditions of heat pump 104. For example, operating conditions of heat pump 104 can include a current actual temperature of the ambient air (e.g., outdoor air) heat pump 104 can extract heat from. As another example, operating conditions of heat pump 104 can include a current actual temperature of a heat transfer fluid that heat pump 104 may sink heat into (e.g., to transfer heat to a refrigerant that can be used to heat a building space).

The operating information of heat pump 104 can be transmitted to controller 102 via a network relationship. For example, the operating information of heat pump 104 can be transmitted to controller 102 via a wired or wireless network.

The wired or wireless network can be a network relationship that connects heat pump 104 to controller 102. Examples of such a network relationship can include a local area network (LAN), wide area network (WAN), personal area network (PAN), a distributed computing environment (e.g., a cloud computing environment), storage area network (SAN), Metropolitan area network (MAN), a cellular communications network, and/or the Internet, among other types of network relationships.

Controller 102 can determine a first set point of at least one of a number of components of heat pump 104 and a first operating temperature of evaporator 106 that correspond to operation of heat pump 104 at a first operating energy efficiency (e.g., the instantaneous operating energy efficiency) based on the operating information of heat pump 104. A first operating temperature of evaporator 106 can be an optimum operating temperature that can correspond to the first operating energy efficiency of the operating information of heat pump 104. The first operating efficiency can be a highest instantaneous energy efficiency of heat pump 104 (e.g., as distinguished from a time averaged value). That is, based on the instantaneous operating information of heat pump 104, there exists a set point (e.g., the first set point) for a number of components of heat pump 104 (e.g., as will be further described herein) for a highest possible instantaneous coefficient of performance (COP) of heat pump 104. This highest instantaneous COP can correspond to the optimum operating temperature of evaporator 106. That is, the first (e.g., optimum) operating temperature of evaporator 106 can be associated with an optimum COP of heat pump 104 based on the operating information of heat pump 104.

Controller 102 can receive a second operating temperature of evaporator 106 that is positively offset from the first operating temperature of evaporator 106 associated with the operating information of heat pump 104. That is, controller 102 can receive an offset operating temperature of evaporator 106 that is offset (e.g., warmer) from an optimum operating temperature of evaporator 106.

As used herein, COP can be a ratio of heating energy provided by heat pump 104 to electrical energy consumed to provide that heat energy. An optimum COP of heat pump 104 can refer to heat pump 104 operating at a maximum heating energy delivered with the least electrical energy consumed for current operating information of heat pump 104.

An evaporator, as used herein, can include a coil that includes refrigerant, wherein the refrigerant flowing from the evaporator carries thermal energy from a low temperature reservoir (e.g., ambient air) to a high temperature reservoir (e.g., a building space). As used herein, a positively offset operating temperature can be an operating temperature of evaporator 106 that is positively offset by a constant value from a predetermined operating temperature of evaporator 106.

Ice formation on the surface of evaporator 106 can act as insulation, reducing the efficiency of evaporator 106 by reducing the heat transfer coefficient of evaporator 106. The speed of ice formation on evaporator 106 can be decreased with a decreasing difference between air temperature (e.g., ambient air temperature) and the operating temperature of evaporator 106. Therefore, the second (e.g., the offset) operating temperature of evaporator 106 can be higher than the first operating temperature of evaporator 106 to slow ice formation.

For example, an optimum operating temperature of evaporator 106 can be −13 C, and a positively offset operating temperature of evaporator 106 can be −10 C. An operating temperature of evaporator 106 that is warmer than the optimum operating temperature of evaporator 106 can slow ice formation speed on the surface of evaporator 106.

Although the positively offset operating temperature is described as being three degrees warmer than the optimal operating temperature, embodiments of the present disclosure are not so limited. For example, the positively offset operating temperature can be more than three degrees warmer or less than three degrees warmer than the optimal operating temperature of evaporator 106.

The positively offset operating temperature of evaporator 106 can be associated with a COP that is lower than the optimum COP associated with the optimum operating temperature of evaporator 106. For example, the positively offset operating temperature of evaporator 106 can be warmer than the predefined operating temperature of evaporator 106 to extend a heating interval of heat pump 104, but in turn lowering the COP of heat pump 104. However, the warmer offset operating temperature of evaporator 106 can allow for a longer heating interval length of heat pump 104, lowering the overall cost of operation of heat pump 104, as will be further described herein.

The positively offset operating temperature of evaporator 106 can be fixed for all operating conditions of heat pump 104. For example, the positively offset operating temperature of evaporator 106 can be three degrees warmer than the optimum operating temperature of evaporator 106 for all operating conditions of heat pump 104, although embodiments of the present disclosure are not so limited to a three degree difference between the positively offset operating temperature and the optimum operating temperature of evaporator 106. That is, even though operating conditions such as fluid and air temperatures (e.g., as will be further described herein) fluctuate during operation of heat pump 104, the positively offset operating temperature of evaporator 106 can be fixed for changes in operating conditions of heat pump 104.

Controller 102 can determine a second set point of at least one of the number of components of heat pump 104 that correspond to an operation of heat pump 104 at a second operating energy efficiency corresponding to the second (e.g., positively offset) operating temperature of evaporator 106, where the positively offset operating temperature of evaporator 106 can be determined or received for different combinations of operating conditions. The second operating temperature can correspond to a second operating energy efficiency. That is, the second operating energy efficiency can be an energy efficiency that is associated with a COP that is lower than the optimum COP associated with the optimum operating temperature of evaporator 106. Therefore, the first operating energy efficiency can be a highest instantaneous energy efficiency based on the received instantaneous operating information of heat pump 104, and the second operating energy efficiency can be a highest instantaneous energy efficiency based on the positively offset operating temperature of evaporator 106, where the second operating energy efficiency is lower relative to the first operating energy efficiency.

The positively offset operating temperature of evaporator 106 can be determined by adding a time average cost of defrosting evaporator 106 and a time average cost of heating by heat pump 104. For example, an optimized offset temperature can be determined by the following equation:

$$U(0) = 1, \tag{1}$$

$$\min_{\tau,\Delta T_E} \frac{c_{DEFROST}}{\tau_D + \tau} + \frac{1}{\tau}\int_0^{\tau} c_E \dot{Q}_{SP} COP^*(U(t), \Delta T_E)\, dt,$$

$$\text{s.t. } \frac{dU(t)}{dt} = f(U(t), T_E(t)),$$

where $\tau_D$ is the defrosting interval of evaporator 106, $C_{DEFROST}$ is the defrosting cost of evaporator 106, $C_E$ is the electricity cost, $\dot{Q}_{SP}$ is the heat demand, U(t) is the heat transfer coefficient of evaporator 106 as a function of time, $\Delta T_E$ is the positively offset operating temperature of evaporator 106, and COP*(U(t), $\Delta T_E$) is the coefficient of performance of heat pump 104 based on the heat transfer coefficient of evaporator 106 as a function of time and the positively offset operating temperature of evaporator 106.

The time average cost of defrosting can be determined using a defrosting cost and a defrosting interval length. For example, $$\min_{\tau,\Delta T_E} \frac{c_{DEFROST}}{\tau_D + \tau}$$

of

Equation 1 can be used to determine the minimum time average cost of defrosting by dividing the defrosting cost of evaporator 106 (e.g., $C_{DEFROST}$) by the defrosting interval (e.g., $\tau_D+\tau$).

The operating information of heat pump 104 can include a heat transfer coefficient of evaporator 106, where the time average cost of heating is determined by a COP of heat pump 104 using the heat transfer coefficient of evaporator 106 and the positively offset operating temperature of evaporator 106. For example, the COP of heat pump 104 is a function of the heat transfer coefficient that changes as a function of time (e.g., U(t)) as well as the positively offset operating temperature that does not change as a function of time (e.g., $\Delta T_E$).

The heating interval length of heat pump 104 based on the positively offset operating temperature of evaporator 106 can be longer than a heating interval length of heat pump 104 based on the predetermined operating temperature of evaporator 106. For example, a heating interval length of heat pump 104 based on a first (e.g., optimum) operating temperature of evaporator 106 of −13 C can be 80 minutes, and the heating interval length of heat pump 104 based on the positively offset operating temperature of evaporator 106 of −10 C can be 105 minutes.

As used herein, a heating interval length can be the length of time heat pump 104 operates in a heating mode. For example, if heat pump 104 operates to heat an indoor building space for 60 minutes, the heating interval length of heat pump 104 is 60 minutes.

Although the heating interval length of heat pump 104 based on the first (e.g., optimum) operating temperature of evaporator 106 and the positively offset operating temperature of evaporator 106 are described as being 80 minutes and 105 minutes, respectively, embodiments of the present disclosure are not so limited. For example, the heating interval length of heat pump 104 based on the first (e.g., optimum) operating temperature of evaporator 106 can be longer or shorter than 80 minutes. Additionally, the heating interval length of heat pump 104 based on the positively offset operating temperature of evaporator 106 can be longer or shorter than 105 minutes.

Cost of operation of heat pump 104 can be determined by the following equation:

$$\text{Cost of Operation} = \frac{\text{Heating Interval Cost} + \text{Defrosting Interval Cost}}{\text{Duration of Heating Interval} + \text{Duration of Defrost Interval}} \tag{2}$$

As illustrated by Equation 2, by extending the heating interval length of heat pump 104, the cost of operation of heat pump 104 can be reduced.

Controller 102 can modify a set point of at least one of a number of components of heat pump 104 based on the operating information such that a heating mode of heat pump 104 is enabled for the heating interval length of heat pump 104. For example, a set point of a component of heat pump 104 can be modified to the determined second set point such that heat pump 104 operates in heating mode for the heating interval length of heat pump 104.

The number of components of heat pump 104 can include a compressor. The compressor can pressurize and circulate a heat transfer fluid through heat pump 104. For example, the heat transfer fluid, in a gaseous state, can be pressurized and circulated by the compressor. As used herein, a compressor can be a mechanical device that increases the pressure of a gas (e.g., heat transfer fluid) by reducing its volume. A set point of the compressor, such as compressor speed, can be modified such that the heating mode of heat pump 104 is enabled for the heating interval length of heat pump 104.

The number of components of heat pump 104 can include a water pump. The water pump can circulate a working fluid (e.g., water) past a condenser of heat pump 104 so that the condenser can transfer heat to the working fluid, allowing the working fluid to heat a building space. A set point of the water pump, such as water pump speed, can be modified such that the heating mode of heat pump 104 is enabled for the heating interval length of heat pump 104.

The number of components of heat pump 104 can include a fan. The fan can circulate a working fluid by a condenser of heat pump 104 so that the condenser transfers heat to the working fluid, allowing the working fluid to heat a building space. A set point of the fan, such as fan speed, can be modified such that the heating mode of heat pump 104 is enabled for the heating interval length of heat pump 104.

The number of components of heat pump 104 can include an expansion valve. A heat transfer fluid, after passing through a condenser of heat pump 104, can pass through an expansion valve to lower the pressure of the heat transfer fluid. As used herein, an expansion valve can be a flow-restricting device that causes a pressure drop of the heat transfer fluid. A set point of the expansion valve, such as valve position, can be modified such that the heating mode of heat pump 104 is enabled for the heating interval length of heat pump 104.

The set points associated with the number of components of heat pump 104 can be modified within a predetermined range. For example, the expansion valve positioning may be modified within a process limit of heat pump 104 to ensure the heat transfer fluid does not condense into a liquid, since allowing liquid to enter the compressor of heat pump 104 can catastrophically damage the compressor.

Determining a second set point of the number of components of the heat pump using the second operating temperature that is positively offset from the first operating temperature, and modifying a set point of at least one of a number of components of the heat pump to the second set point such that a heating mode of the heat pump is enabled for the heating interval length of the heat pump can allow for a lower cost of operation of the heat pump. By extending the heating interval length of the heat pump relative to a heating interval length associated with the predetermined operating temperature and corresponding optimum COP, the number of defrost intervals and/or the length of a defrost interval of the heat pump can be reduced. By increasing the operating temperature of the evaporator and sacrificing an amount of heat pump efficiency, a heating interval length of the heat pump can be lengthened, thereby decreasing the number of defrost cycles of the heat pump, and in effect decreasing the overall cost of operation of the heat pump.

Figure 2:
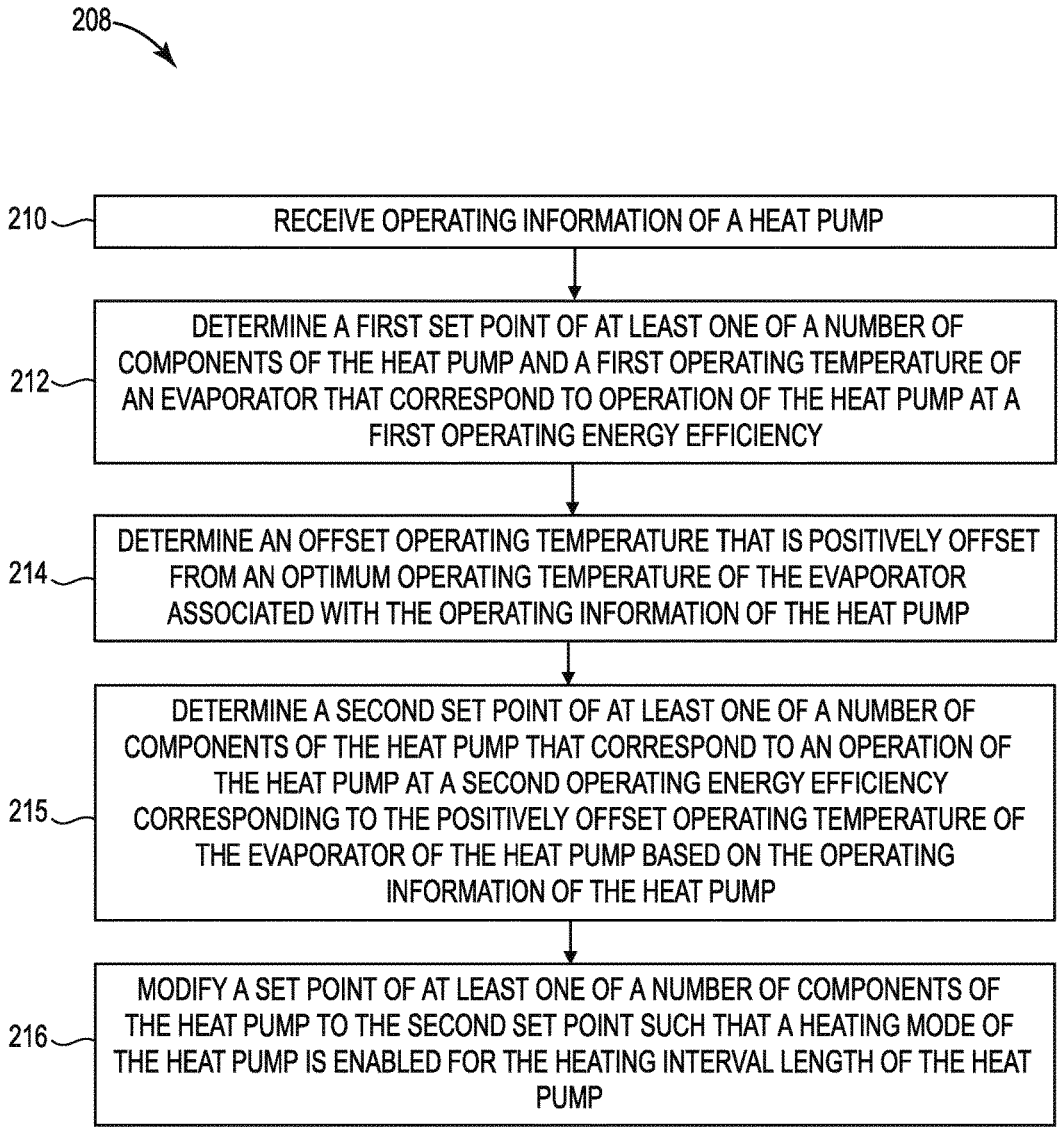
FIG. 2 is a flow chart of a method for frost management of an evaporator, in accordance with one or more embodiments of the present disclosure.

FIG. 2 is a flow chart of a method for frost management of an evaporator, in accordance with one or more embodiments of the present disclosure. Method 208 can be performed by, for example, controllers 102, and 302, described in connection with FIGS. 1, and 3, respectively.

At 210, the method 208 can include receiving operating information of a heat pump. Operating information of a heat pump (e.g., heat pump 104, previously described in connection with FIG. 1) can include user demands, such as a heat demand of a space conditioned by the heat pump. Operating information of the heat pump can also include operating conditions of the heat pump. For example, operating conditions of the heat pump can include a temperature of ambient air (e.g., outdoor air) the heat pump can extract heat from, as well as a temperature of a heat transfer fluid the heat pump may be sinking heat into from the ambient air.

At 212, the method 208 can include determining a first set point of at least one of a number of components of the heat pump and a first operating temperature of an evaporator that correspond to operation of the heat pump at a first operating energy efficiency. For example, the operating information of the heat pump can be used to determine a first set point of a number of components of the heat pump such that the evaporator of the heat pump can realize a first (e.g., optimum) operating temperature that corresponds to a first operating energy efficiency of the heat pump. As used herein, the first operating energy efficiency of the heat pump can be a highest instantaneous energy efficiency that can be associated with highest instantaneous coefficient of performance (COP) of the heat pump. That is, the heat pump can have an optimum COP associated with an optimum operating temperature of the evaporator of the heat pump based on the instantaneous operating information of the heat pump and set points of a number of components of the heat pump.

The method can further include determining a coefficient of performance (COP) of the heat pump based on the positively offset operating temperature and the operating information of the heat pump. For example, the operating information of the heat pump and the positively offset operating temperature can be used to determine a COP of the heat pump while the evaporator is at the positively offset operating temperature.

The COP of the heat pump based on the positively offset operating temperature and the operating information of the heat pump can be lower than the COP of the heat pump based on the optimum operating temperature. That is, the COP of the heat pump using the positively offset operating temperature can be lower such that the positively offset operating temperature of the evaporator is higher in order to slow ice formation on the surface of the evaporator.

At 214, the method 208 can include determining an offset operating temperature that is positively offset from an optimum operating temperature of the evaporator associated with the operating information of the heat pump. The optimum operating temperature of the evaporator can be lower (e.g., colder) than the positively offset operating temperature of the evaporator.

At 215, the method 208 can include determining a second set point of at least one of a number of components of the heat pump that correspond to an operation of the heat pump at a second operating energy efficiency corresponding to the positively offset operating temperature of the evaporator of the heat pump based on the operating information of the heat pump at the point in time. For example, the positively offset operating temperature and the operating information of the heat pump can be used to determine the second set point of a number of components of the heat pump such that the evaporator of the heat pump can realize an positively offset operating temperature, where the positively offset operating temperature can correspond to a slightly lower COP of the heat pump relative to the optimum operating temperature of the evaporator.

At 216, the method 208 can include modifying a set point of at least one of a number of components of the heat pump based on the operating information such that a heating mode of the heat pump is enabled for the heating interval length of the heat pump. For example, a set point such as a speed or position of a compressor, a water pump, a fan, and/or an expansion valve of the heat pump can be modified to the determined second set point such that the evaporator of the heat pump can realize an offset operating temperature.

The method can further include enabling a defrost mode of the heat pump after the heating interval length of the heat pump. For example, after the heating interval length, a defrost mode can be enabled to remove any ice that has formed on the surface of the evaporator of the heat pump.

The method can be continuously repeated. For example, as operating information of the heat pump such as operating conditions change with time, the method can be repeated to modify the heating interval length based on the changing operating information of the heat pump. That is, the method can be repeated to lengthen or shorten the heating interval length as necessary to ensure a cost of operation of the heat pump is reduced relative to a cost of operation using a heating interval length associated with an optimum operating temperature of the evaporator.

FIG. 3 is a schematic block diagram of a controller for crowd comfortable settings, in accordance with one or more embodiments of the present disclosure. Controller 302 can be, for example, controller 102, previously described in connection with FIG. 1. Controller 302 can include a memory 320 and a processor 318 configured for frost management of an evaporator, in accordance with the present disclosure.

The memory 320 can be any type of storage medium that can be accessed by the processor 318 to perform various examples of the present disclosure. For example, the memory 320 can be a non-transitory computer readable medium having computer readable instructions (e.g., computer program instructions) stored thereon that are executable by the processor 318 to receive operating information of a heat pump. Additionally, processor 318 can execute the executable instructions stored in memory 320 to determine a first set point of at least one of a number of components of the heat pump and a first operating temperature of an evaporator that correspond to operation of the heat pump at a first operating energy efficiency at the point in time based on the operating information of the heat pump. Additionally, processor 318 can execute the executable instructions stored in memory 320 to receive a second operating temperature of the evaporator that is positively offset from the first operating temperature of the evaporator associated with the operating information of the heat pump, and determine a second set point of at least one of the number of components of the heat pump that correspond to an operation of the heat pump at a second operating energy efficiency corresponding to the second operating temperature of the evaporator of the heat pump based on the operating information of the heat pump at the point in time. Further, processor 318 can execute the executable instructions stored in memory 320 to modify a set point of at least one of the number of components of the heat pump to the second set point such that a heating mode of the heat pump is enabled for the heating interval length of the heat pump.

The memory 320 can be volatile or nonvolatile memory. The memory 320 can also be removable (e.g., portable) memory, or non-removable (e.g., internal) memory. For example, the memory 320 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disc read-only memory (CD-ROM)), flash memory, a laser disc, a digital versatile disc (DVD) or other optical storage, and/or a magnetic medium such as magnetic cassettes, tapes, or disks, among other types of memory.

Further, although memory 320 is illustrated as being located within controller 302, embodiments of the present disclosure are not so limited. For example, memory 320 can also be located internal to another computing resource (e.g., enabling computer readable instructions to be downloaded over the Internet or another wired or wireless connection).

As used herein, "logic" is an alternative or additional processing resource to execute the actions and/or functions, etc., described herein, which includes hardware (e.g., various forms of transistor logic, application specific integrated circuits (ASICs), etc.), as opposed to computer executable instructions (e.g., software, firmware, etc.) stored in memory and executable by a processor. It is presumed that logic similarly executes instructions for purposes of the embodiments of the present disclosure.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A controller for frost management of an evaporator, the controller comprising:

a memory;

a processor configured to execute executable instructions stored in the memory to:

receive operating information of a heat pump;

determine a first set point of at least one of a number of components of the heat pump and a first operating temperature of the evaporator that corresponds to operation of the heat pump at a first operating energy efficiency based on the operating information of the heat pump and corresponds to a first heating interval length of the heat pump, wherein the first operating energy efficiency is a highest instantaneous energy efficiency of the heat pump;

receive a second operating temperature of the evaporator that is positively offset from the first operating temperature of the evaporator associated with the operating information of the heat pump;

determine a second set point of at least one of the number of components of the heat pump that corresponds to an operation of the heat pump at a second operating energy efficiency corresponding to the second operating temperature of the evaporator of the heat pump based on the operating information of the heat pump, wherein the second operating energy efficiency is lower than the first operating energy efficiency; and modify a set point of at least one of the number of components of the heat pump to the second set point such that a heating mode of the heat pump is enabled for a second heating interval length of the heat pump.

2. The controller of claim 1, wherein the second heating interval length of the heat pump based on the second operating temperature of the evaporator is longer than the first heating interval length of the heat pump based on the first operating temperature of the evaporator.

3. The controller of claim 1, wherein the second operating temperature is higher than the first operating temperature.

4. The controller of claim 1, wherein the operating information of the heat pump includes a heat demand.

5. The controller of claim 1, wherein the operating information of the heat pump includes operating conditions of the heat pump.

6. The controller of claim 1, wherein set points associated with the number of components of the heat pump are modified within a predetermined range.

7. The controller of claim 1, wherein the number of components includes a compressor of the heat pump.

8. The controller of claim 1, wherein the number of components include a water pump of the heat pump.

9. The controller of claim 1, wherein the number of components include a fan of the heat pump.

10. The controller of claim 1, wherein the number of components include an expansion valve of the heat pump.

11. A computer implemented method for frost management of an evaporator, the method comprising:

receiving, by a controller, operating information of a heat pump;

determining, by the controller, a first set point of at least one of a number of components of the heat pump and a first operating temperature of the evaporator that corresponds to operation of the heat pump at a first operating energy efficiency and corresponds to a first heating interval length of the heat pump, wherein the first operating energy efficiency is a highest instantaneous energy efficiency of the heat pump;

determining, by the controller, an offset operating temperature that is positively offset from the first operating temperature of the evaporator associated with the operating information of the heat pump;

determining, by the controller, a second set point of at least one of a number of components of the heat pump that corresponds to an operation of the heat pump at a second operating energy efficiency corresponding to the positively offset operating temperature of the evaporator of the heat pump based on the operating information of the heat pump, wherein the second operating energy efficiency is lower than the first operating energy efficiency; and modifying, by the controller, a set point of at least one of the number of components of the heat pump to the second set point such that a heating mode of the heat pump is enabled for a second heating interval length of the heat pump.

12. The method of claim 11, wherein receiving operating information of the heat pump includes receiving a heat demand of the heat pump.

13. The method of claim 11, wherein the method further includes determining a coefficient of performance (COP) of the heat pump based on the offset operating temperature and the operating information of the heat pump.

14. The method of claim 13, wherein the COP of the heat pump based on the offset operating temperature and the operating information of the heat pump is lower than a COP of the heat pump based on the first operating temperature.

15. The method of claim 11, wherein the method further includes enabling a defrost mode of the heat pump after the second heating interval length of the heat pump.

16. The method of claim 11, wherein the method is continuously repeated.

17. A system for frost management, the system comprising:

a heat pump;

an evaporator of the heat pump; and a controller, configured to:

receive operating information of the heat pump;

determine, using the operating information of the heat pump, a first set point of at least one of a number of components of the heat pump and a first operating temperature of the evaporator that corresponds to operation of the heat pump at a first operating energy efficiency and corresponds to a first heating interval length of the heat pump, wherein the first operating energy efficiency is a highest instantaneous energy efficiency of the heat pump;

receive a second operating temperature of the evaporator that is positively offset from the first operating temperature of the evaporator associated with the operating information of the heat pump;

determine a second set point of at least one of the number of components of the heat pump that corresponds to an operation of the heat pump at a second operating efficiency corresponding to the second operating temperature of the heat pump based on the operating information of the heat pump at the point in time, wherein the second operating energy efficiency is lower than the first operating energy efficiency; and modify a set point of at least one of the number of components of the heat pump to the second set point such that a heating mode of the heat pump is enabled for a second heating interval length of the heat pump.

18. The system of claim 17, wherein the second operating temperature of the heat pump is determined by adding a time average cost of defrosting and a time average cost of heating.

19. The system of claim 18, wherein the time average cost of defrosting is determined using a defrosting cost and a defrosting interval length.

20. The system of claim 18, wherein the operating information of the heat pump includes a heat transfer coefficient of the evaporator, and wherein the time average cost of heating is determined by a coefficient of performance (COP) of the heat pump using the heat transfer coefficient of the evaporator and the second operating temperature of the evaporator.

* * * * *